United States Patent [19]

Chipman

[11] 4,174,095

[45] Nov. 13, 1979

[54] HYDRAULIC JACK

[75] Inventor: Donald I. Chipman, Estherville, Iowa

[73] Assignee: General Electric Company, Schenectady, N.Y.

[21] Appl. No.: 878,729

[22] Filed: Feb. 17, 1978

[51] Int. Cl.[2] ..... B66F 3/24

[52] U.S. Cl. ..... 254/93 H

[58] Field of Search ..... 254/93 H, 93 R; 92/108, 92/107, 117

[56] References Cited

U.S. PATENT DOCUMENTS

| | | | |
|---|---|---|---|
| 2,163,982 | 6/1939 | Mercier | 92/107 X |
| 2,429,014 | 10/1947 | Christopher | 254/93 H |
| 2,535,759 | 12/1950 | Schwantner | 254/93 H X |
| 3,890,684 | 6/1975 | Tallman | 254/93 H X |

*Primary Examiner*—Robert C. Watson

*Attorney, Agent, or Firm*—Nathan D. Herkamp; Joseph T. Cohen; Paul R. Webb, II

[57] ABSTRACT

A hydraulic jack includes a fixed, cylindrical member mounted on a base, and a moveable member mounted exteriorly around and shiftable on the fixed member. The interior of the fixed and moveable members defines an expandable and contractable chamber, which, when expanded with hydraulic liquid extends the jack upwardly. The space between the exterior surface of the fixed member and the interior surface of the moveable member defines a second expandable and contractable chamber, which, when expanded with hydraulic liquid retracts the jack downwardly. Adjustable lift elements are mounted on the moveable member and are adapted to engage a device to be elevated.

5 Claims, 3 Drawing Figures

HYDRAULIC JACK

SUMMARY OF THE INVENTION

This invention relates to jack devices and more particularly to hydraulic jacks which are adjustable through a wide range of adjustments independently of the hydraulic stroke.

In many prior art hydraulic jacks, one must first extend the jack before the jack engages the device to be elevated. Therefore, part of the power stroke is used to adjust the jack prior to the actual lifting of the device to be elevated and one does not obtain maximum advantage of the of the power stroke. In other instances, the hydraulic jack must be elevated by placing the jack on a support because the jack, when placed on the ground surface, cannot be extended a sufficient amount to raise the device or vehicle. It will be further appreciated that by placing a hydraulic jack on a support above the surface of the ground may create a dangerous situation since the hydraulic jack may slip from the support.

It is therefore a general object of this invention to provide an improved hydraulic jack which may be mechanically adjusted through a wide range of adjustments to engage the device to be elevated whereby the hydraulic power stroke is used entirely for lifting the device to be elevated.

A more specific object of this invention is to provide a hydraulic jack including fixed immoveable members which define a pair of chambers that expand and contract in response to hydraulic pressure, the moveable member having a pair of lift elements thereon which are mechanically adjustable through a wide range of adjustments thereby permitting the hydraulic power stroke of the jack to be used entirely for lifting the device to be elevated.

These and other objects and advantages of this invention will more fully appear from the following description made in connection with the accompanying drawings, wherein like reference characters refer to the same or similar parts throughout the several views.

FIGURES OF THE DRAWINGS

DESCRIPTION OF THE PREFERRED EMBODIMENT

Figure 2:
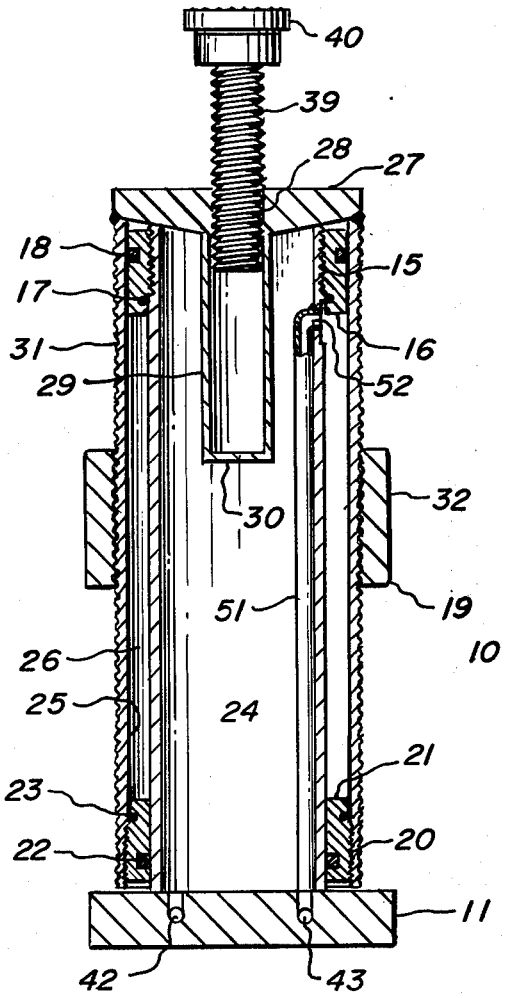
FIG. 2 is a cross-sectional view taken approximately along line 2—2 of FIG. 1 and looking in the direction of the arrows.
Figure 3:
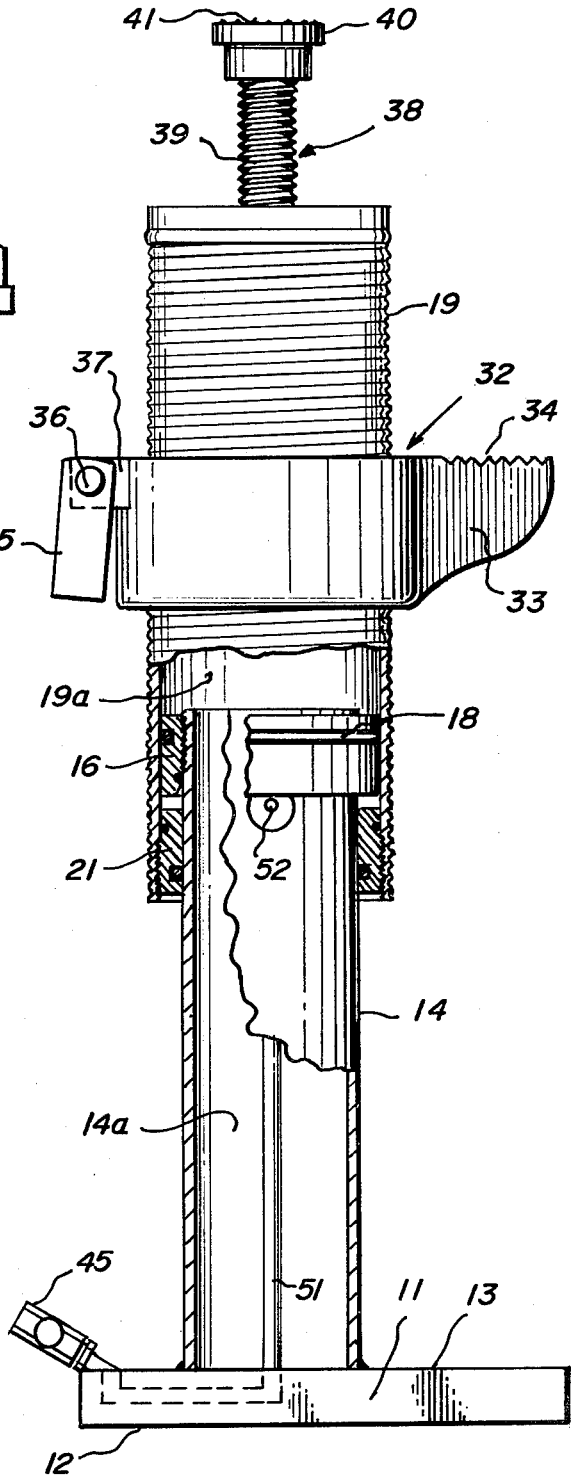
FIG. 3 is a side elevational view of the jack device in an extended position with parts thereof broken away for clarity.

Referring now to the drawings, it will be seen that one embodiment of the novel hydraulic jack, designated generally by the reference numeral 10, is thereshown. The hydraulic jack 10 includes a rectangular shaped base plate 11 having a flat lower surface 12 and having a flat upper surface 13. An elongate, fixed cylindrical member 14 is rigidly affixed to the upper surface 13 of the base plate 11 by welding and has an externally threaded upper end portion 15. An internally threaded nut 16 threadedly engages the threaded upper end portion 15 on the fixed cylindrical member 14, as best seen in FIGS. 2 and 3. The internally threaded nut 16 has an annular groove therein on the inner surface thereof which accommodates an O-ring inner seal element 17.

The threaded nut also has an annular groove in its external surface for accommodating an outer annular seal element 18. The inner seal element 17 engages the external surface of the fixed cylindrical member in sealing relation therewith.

An elongate moveable cylindrical member 19 is positioned concentrically around the fixed cylindrical member 14 and is provided with an internally threaded lower end portion 20 which is threadedly engaged by an externally threaded nut 21. The externally threaded nut 21 has an annular groove in the inner surface thereof for accommodating an inner annular seal element 22 which sealingly engages the external surface 24 of the fixed cylindrical member 14 in sealing relation. The nut 21 also has an annular groove in the outer surface thereof for accommodating an outer annular seal element 23 therein which sealingly engages the inner surface 25 of the moveable cylindrical member 19. The externally threaded nut 21 is moveable with the moveable cylindrical member 19 and has sliding sealing contact with the surface of the fixed cylindrical member 14.

It will be noted that the internal surface 25 of the moveable cylindrical member 19 is spaced concentrically outwardly of the external surface 24 of the fixed cylindrical member 14 to define a generally cylindrical volumetric space 26 therebetween. An end member 27 is secured to the upper end of the moveable cylindrical member 19 in fixed relation thereto as by welding, the end member having a threaded bore 28 through the central portion thereof. A tubular receptacle 29 is affixed to the lower surface of the end member 27 and has a lower end wall 30 whereby the interior of the tubular receptacle 29 is sealed from the interior **14*a* of the fixed cylindrical member 14 and from the interior 19*a* of the moveable cylindrical member 19**.

Referring now to FIG. 3, it will be seen that the moveable cylindrical member 19 is provided with external threads 31 substantially throughout the length of the moveable member. An annular lift member 32 is internally threaded and threadedly engages the threads 31 on the exterior surface of the moveable cylindrical member 19 and is vertically adjustable relative thereto. The lift member 32 is provided with a load supporting portion 33 which projects outwardly therefrom, the load supporting portion having a substantially flat, serrated, upper surface 34 which is adapted to engage a device to be lifted such as a vehicle or the like. A U-shaped element or bail 35 is pivotally connected by a pivot 36 to a lip 37 on the annular lift member 32 and projects outwardly therefrom oppositely of the load supporting portion 33. The U-shaped element 35 is adapted to be connected by a suitable chain or the like for moving the hydraulic jack.

The hydraulic jack 10 is also provided with a second lift member 38 which includes an elongate threaded shank 39 that threadedly engages the bore 28 in the end member 27. The lift member 38 has a load supporting element 40' integral with the upper end thereof, the load supporting element having a knurled, flat upper surface 41 which is also adapted to engage a device to be lifted such as a vehicle or the like.

Figure 1:
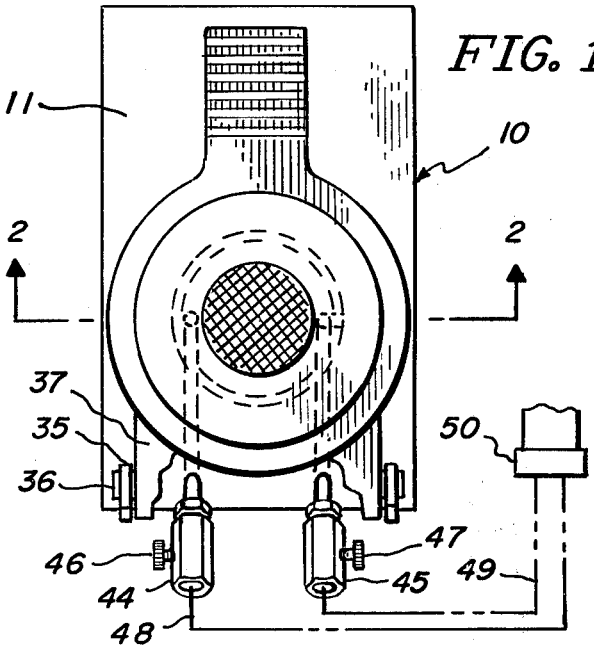
FIG. 1 is s top plan view of the hydraulic jack, will certain parts thereof broken away for clarity.

Referring again to the FIGS. 1 and 2, it will be seen that the base plate 11 has passages 42 and 43 therein each extending through the upper surface 13 of the base plate. A pair of fittings 44 and 45 are secured to the upper surface of the base plate, and the fitting 44 communicates with the passage 42 while the fitting 45 communicates with the passage 43. The fitting 44 has an adjustable needle valve 46 therein and the fitting 45 has an adjustable needle valve 47 therein. The fitting 44 is connected by a conduit 48 in communicating relation with a control valve 50 which is connect to a source of hydraulic fluid under pressure. Similarly, the fitting 45 is connected by a conduit 49 to the control valve 50. It is pointed out that although the needle valves 46 and 47 may be manipulated to control the flow of hydraulic fluid through the passages 42 and 43, the flow of hydraulic fluid through the passages is primarily controlled by the control valve 50.

It will be seen that the passage 42 communicates with the interior 14*a* of the fixed cylindrical member 14 and with that portion of the interior 19*a* of the moveable member located above the nut 16 on the fixed cylindrical member. The interior member 14*a* and the interior 19*a* located above the nut 16 define an expandable and contractable first chamber. The passage 43 is connected in communicating relation to the lower end of a conduit which is positioned interiorly of the fixed cylindrical member 14 and has an upper end which communicates with a port 52 which opens or communicates with the volumetric space 26 located between the nut 16 and the nut 21. This last mentioned volumetric space 26 defines a second expandable and contractable chamber which communicates with the passage 43.

When the hydraulic jack 10 is not being used, the moveable cylindrical member 19 will be retracted downwardly to the position illustrated in FIG. 3. When it is desirable to use the jack to elevate a device, such as a vehicle, the jack will be positioned below that portion of the device to be lifted, and the operator then determines which of the two lift members 32 or 38 will be used. If the lift member 32 is to be used, the lift member 38 may be adjusted downwardly until it is retracted into the receptacle 29. The lift member 32 will then be vertically adjusted so that the surface 34 engages that portion of the vehicle to be lifted.

In the event that the second lift member 38 is to be used, this lift member will then be adjusted until it engages that portion of the vehicle to be lifted. The use of the two lift members provides a wide range of mechanical adjustments to assure engagement by one of the lift members of the vehicle to be lifted.

After the selected lift member is adjusted to engage the device to be lifted, the operator will then manipulate the control valve 50 so that the fluid will flow through the passage 42 into the interior 14*a* of the fixed cylindrical member. When this occurs, the fluid pressure will cause the moveable cylindrical member to be shifted vertically upwardly so that fluid will then flow into the volumetric space 19*a* located above the nut 16. The device to be lifted will then be elevated to the desired height. When hydraulic fluid is introduced through the passage 42 into the expanding chamber defined by the spaces 14*a* and 19*a*, the hydraulic fluid contained within the chamber 26 will be evacuated therefrom through the port 52, the conduit 51 and through the passage 43.

When it is desirable to retract the jack to the lower position, the control valve 50 will be manipulated so that fluid will be directed through the conduit 49 into the passage 43 and then through the conduit 51 into the chamber 26. The fluid pressure will cause the moveable cylindrical member to move downwardly until the moveable member is completely retracted. Thus, it will be seen that the jack 10 uses a power stroke to both raise and lower the moveable member.

From the foregoing description, it will be seen that I have provided a novel hydraulic jack, which is not only of simple and inexpensive construction, but one which functions in a more efficient manner than any heretofore known comparable device.

What is claimed is:

1. A hydraulic jack comprising:

a base, an elongate, cylindrical, fixed member mounted on said base and projecting upwardly therefrom an elongate, cylindrical, moveable member positioned exteriorly around said fixed member and having its inner surface spaced from the exterior surface of said fixed member, means closing the upper end of said moveable member, the interior of said fixed and moveable members defining an expandable and contractable first chamber, the space defined between the exterior surface of said fixed member and the interior surface of said moveable member defining a second expandable and contractable chamber, a pair of passage means in said base and being connected to a source of fluid under pressure, one of said passage means being connected in communicating relation to said first chamber and the other passage means being connected to a conduit projecting upwardly from the base through the interior of said fixed member and being connected to a part in the upper end portion of said fixed member, said part being connected in communicating relation to said second chamber whereby when fluid is directed through said one passage means into said first chamber, said moveable member will be shifted vertically upwardly and fluid will be evacuated from said second chamber, and when fluid is directed through the other passage means into said chamber, the moveable member will be shifted vertically downwardly and fluid will be evacuated from said first chamber through said first passage means, and a lift element on said moveable member being vertically adjustable relative thereto, said lift element adapted to engage a device to be elevated by said jack, whereby when said moveable member is shifted vertically upwardly relative to said fixed member, the device engaged by the lift member will be elevated.

2. The hydraulic jack as defined in claim 1 wherein said moveable member is provided with external threads, and said lift element threadedly engages said threads on the moveable member.

3. The hydraulic jack as defined in claim 1 and a second lift element on said moveable member and being vertically adjustable relative thereto, thereby said lift elements may be selectively used with different devices to be elevated.

4. The hydraulic jack as defined in claim 3 wherein said second lift element is mounted on the upper end of said moveable member and is adjustably extensible and retractable relative thereto.

5. The hydraulic jack as defined in claim 1 wherein said moveable member has an end member affixed to the upper end thereof, and means secured to the lower end portion of said moveable member projecting radially inwardly therefrom and sealingly engaging the exterior surface of said fixed member.

* * * * *